US007104144B1

(12) United States Patent
Hsieh

(10) Patent No.: US 7,104,144 B1
(45) Date of Patent: Sep. 12, 2006

(54) HANDLE TOOL WITH HIGH SENSITIVE ELECTRONIC STRAIN MEASUREMENT

(76) Inventor: Chih-Ching Hsieh, 235 Chung-Ho P.O. Box 8-24, Taipei (TW)

( * ) Notice: Subject to any disclaimer, the term of this patent is extended or adjusted under 35 U.S.C. 154(b) by 0 days.

(21) Appl. No.: 11/191,210

(22) Filed: Jul. 28, 2005

(51) Int. Cl.
*B25B 23/14* (2006.01)

(52) U.S. Cl. ..... 73/862.21

(58) Field of Classification Search . 73/862.21–862.22
See application file for complete search history.

(56) References Cited

U.S. PATENT DOCUMENTS 4,641,538 A * 2/1987 Heyraud ..... 73/862.26
5,501,107 A * 3/1996 Snyder et al. ..... 73/862.23
6,928,885 B1 * 8/2005 Shiao et al. ..... 73/862.21

* cited by examiner

*Primary Examiner*—Max Noori

(57) ABSTRACT

A handle tool with high sensitive electronic strain measurement comprises a driving portion for driving an object; a handle connected to the driving portion; the handle having an integrating element; a first groove and a second groove being formed at two sides of the handle and are near the driving portion; a length of the first groove being greater than that of the second groove; a strain gauge being embedded in the first groove; the strain gauge being electrically connected to the integrating element; the strain gauge being deformable with the deformation of handle of the tool body; the twisting force applied to the handle being calculated by the integrating element. A display and at least one adjusting button are installed on the integrating element; the display serves for displaying the twisting force calculated on by the integrating element and the adjusting button serves to change the display unit or calibration or reset.

4 Claims, 6 Drawing Sheets

HANDLE TOOL WITH HIGH SENSITIVE ELECTRONIC STRAIN MEASUREMENT

FIELD OF THE INVENTION

The present invention relates to handle tools with strain gauges, and in particular to a handle tool with high sensitive electronic strain measurement, wherein only one strain gauge is used, but the precise value of the twisting force applied to the handle tool can be measured.

BACKGROUND OF THE INVENTION

In some prior art tool bodies, strain gauges are installed for getting the twisting forces applied to the tool body. However generally, theses strain gauges have no sufficient sensitivities for providing a precise twisting force value. Thereby it will cause that the tool body with precise control cannot be used.

In one improvement, the tool body is formed with a round recess and the strain gauge is installed in the recess. However since the recess has a round shape and the strain gauge is installed at a center of the recess, but is operation, the stresses of the tool body are concentrated on the lateral wall of the recess and thus as a result, the deformation of the strain gauge is smaller and thus it cannot provide a precise value about the measured twisting force. Thereby this way can be effectively increase the sensitivity of the strain gauge.

In another improvement, U.S. Pat. No. 4,006,629, two sides of a handle tool are formed with grooves and four strain gauges are installed in the grooves. However in the patent, a conductive wire for a display of the handle tool is exposed out. It is easy to be collided or broken so as to make the strain gauges cannot work. Thereby the structure is complicated and four strain gauges are used. These all increase the cost of the handle tool.

SUMMARY OF THE INVENTION

Accordingly, the primary object of the present invention is to provide a handle tool with high sensitive electronic strain measurement, wherein only one strain gauge is used, but the precise value of the twisting force applied to the handle tool can be measured.

To achieve above objects, the present invention provides a handle tool with high sensitive electronic strain measurement which comprises a driving portion for driving an object; a handle connected to the driving portion; the handle having an integrating element; a first groove and a second groove being formed at two sides of the handle and are near the driving portion; a length of the first groove being greater than that of the second groove; a strain gauge being embedded in the first groove; the strain gauge being electrically connected to the integrating element, the strain gauge being deformable with the deformation of handle of the tool body; the twisting force applied to the handle being calculated by the integrating element. A display and at least one adjusting button are installed on the integrating element; the display serves for displaying the twisting force calculated on by the integrating element and the adjusting button serves to change the display unit or calibration or reset.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
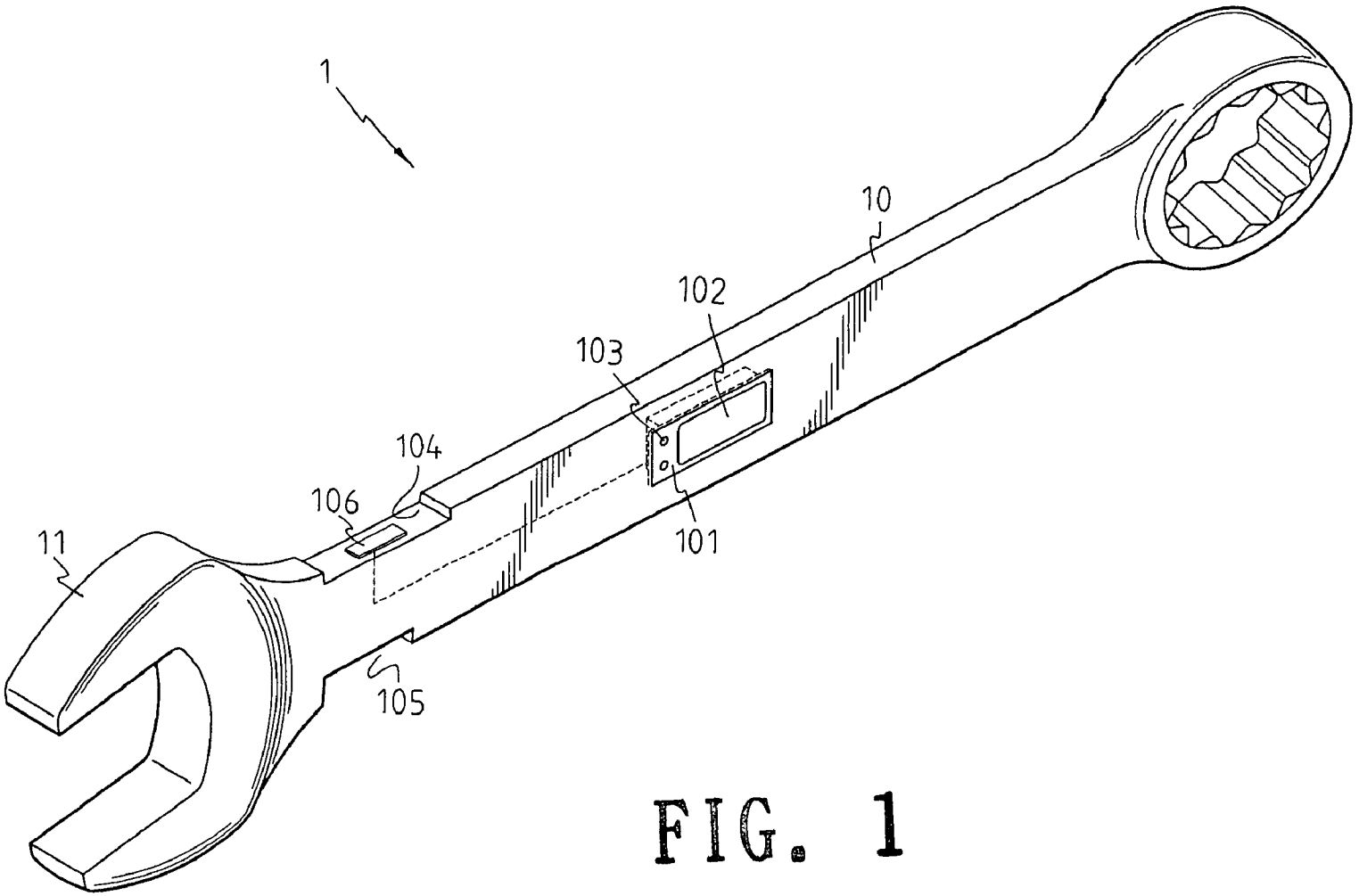
FIG. 1 is a perspective view of the handle tool with high sensitive electronic strain measurement of the present invention.
Figure 2:
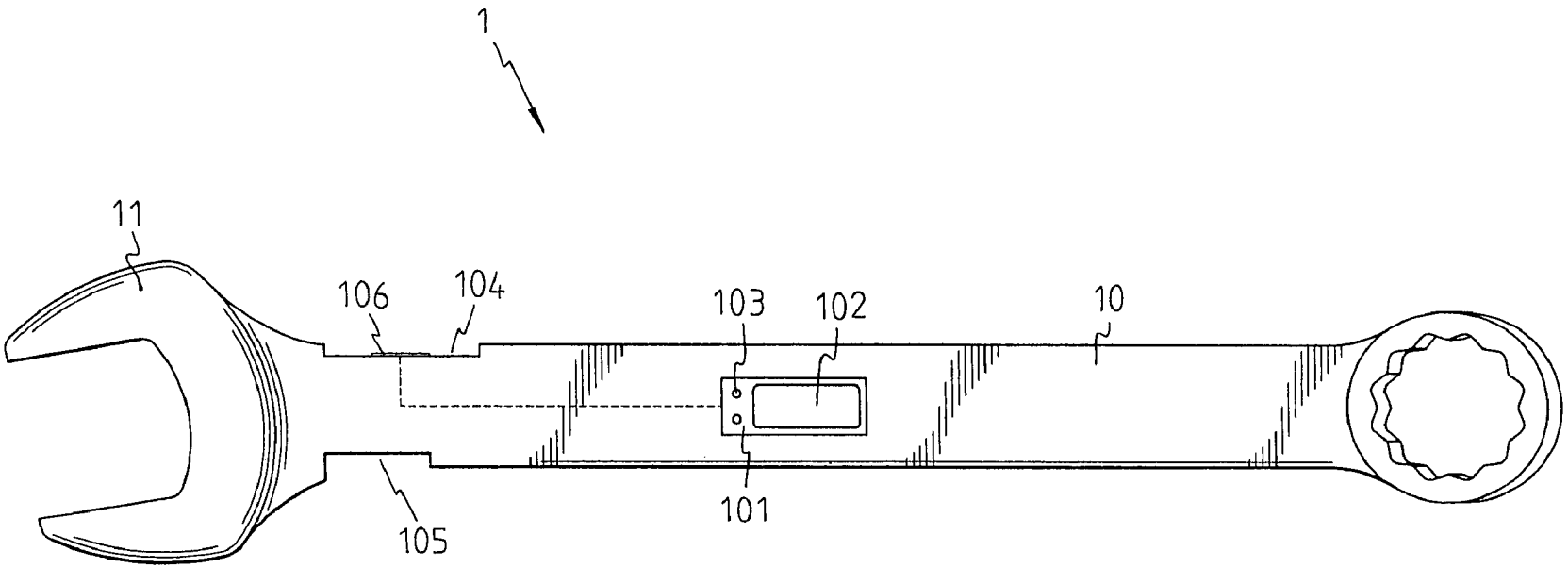
FIG. 2 is a lateral view of the handle tool with high sensitive electronic strain measurement of the present invention.
Figure 3:
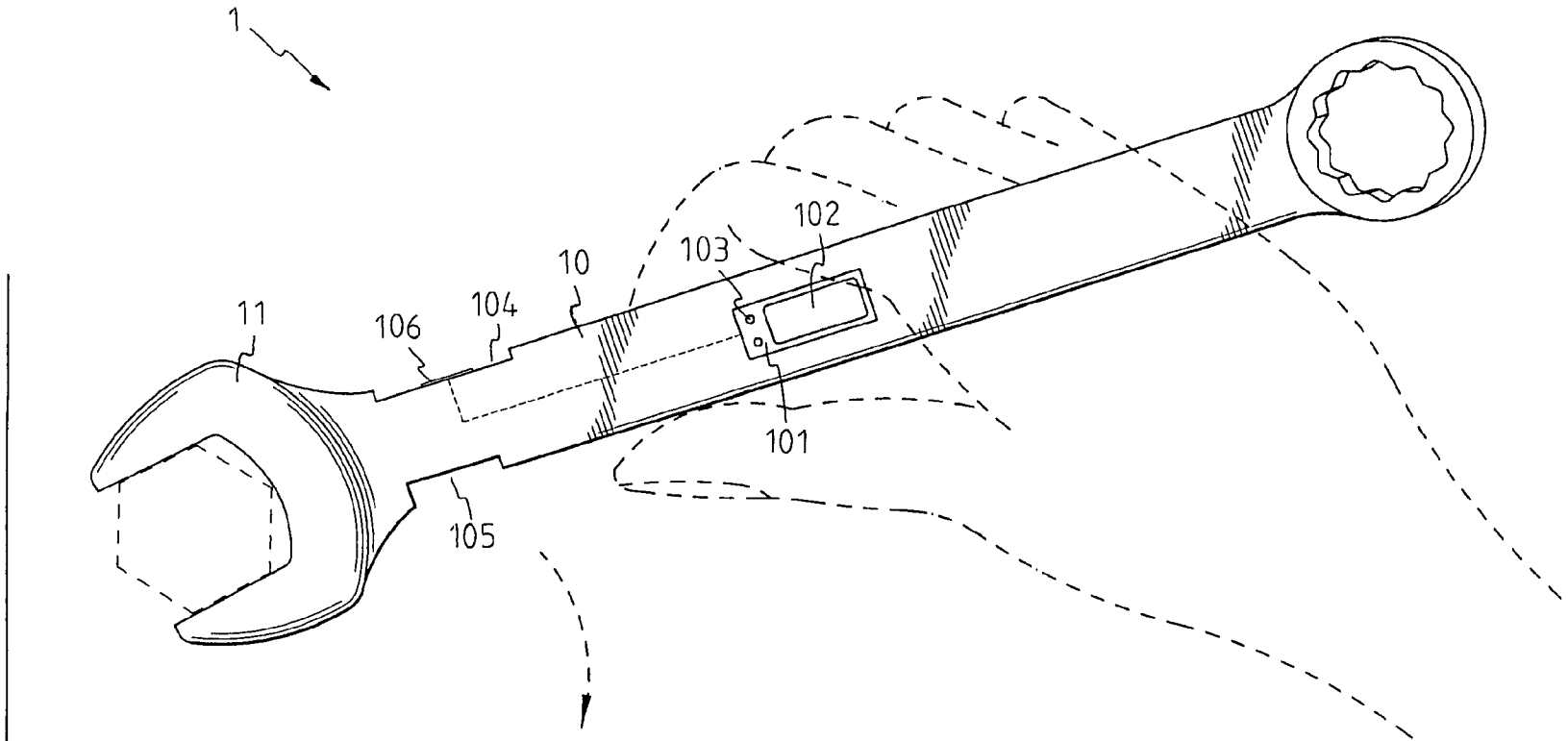
FIG. 3 is a schematic view about the handle tool with high sensitive electronic strain measurement of the present invention.

Referring to FIGS. 1 to 3, the handle tool with high sensitive electronic strain measurement of the present invention is illustrated. The handle tool with high sensitive electronic strain measurement has the following elements.

A driving portion 11 serves for engaging with a screw unit. In this embodiment, the driving portion 11 is formed as an opened spanner, but it can be a ring spanner, a socket spanner, a ratchet spanner, a wrench, or a rapid operation spanner, etc.

A handle 10 is connected to the driving portion 11. The handle 10 has an integrating element 101. A display 102 and at least one adjusting button 103 are installed on the integrating element 101. A first groove 104 and a second groove 105 are formed at two sides of the handle 10 and are near the driving portion 11. The first groove 104 can generate a greater deformation than that of the second groove 105. For example, a size of the first groove 104 is greater than that of the second groove 105. A strain gauge 106 is embedded in the first groove 104. The strain gauge 106 is electrically connected to the integrating element 101. In use of the tool body 1, the strain gauge 106 is deformable with the deformation of handle 10 of the tool body 1. The change of the twisting force applied to the handle 10 is calculated by the integrating element 101 and then is displayed on the display 102. The adjusting button 103 serves to change the display unit or calibration or reset.

In use of the present invention, the second groove 105 has the function of making the first groove 104 has a greater deformation so that the strain gauge 106 in the first groove 104 has a greater deformation. Thus, the integrating element 101 can calculate precisely through the strain gauge 106. Thereby when driving a screw unit, the twisting force can be displayed and well controlled. There is no too large force being applied.

Figure 4:
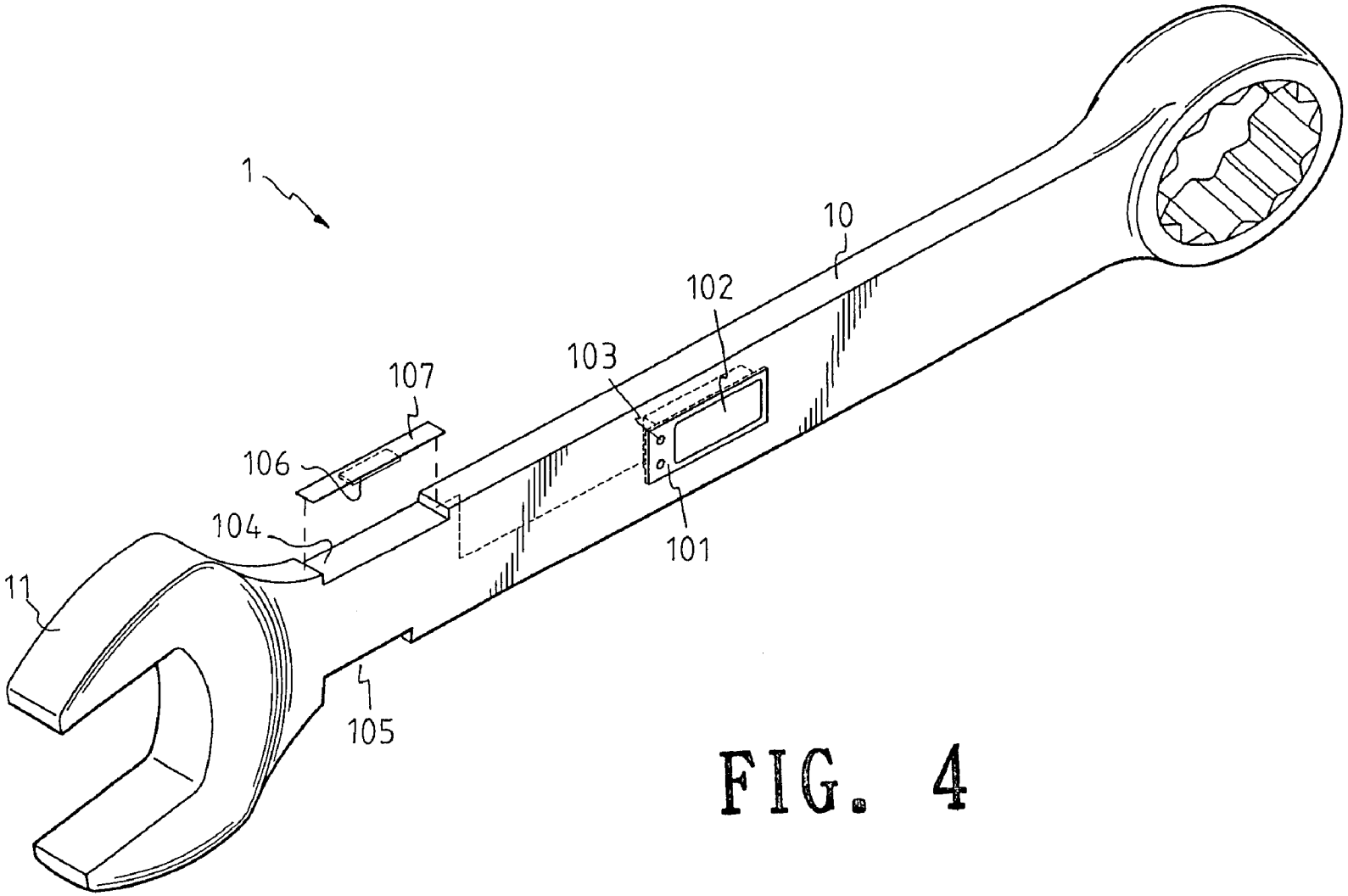
FIG. 4 is an exploded perspective view of the second embodiment of the present invention.
Figure 5:
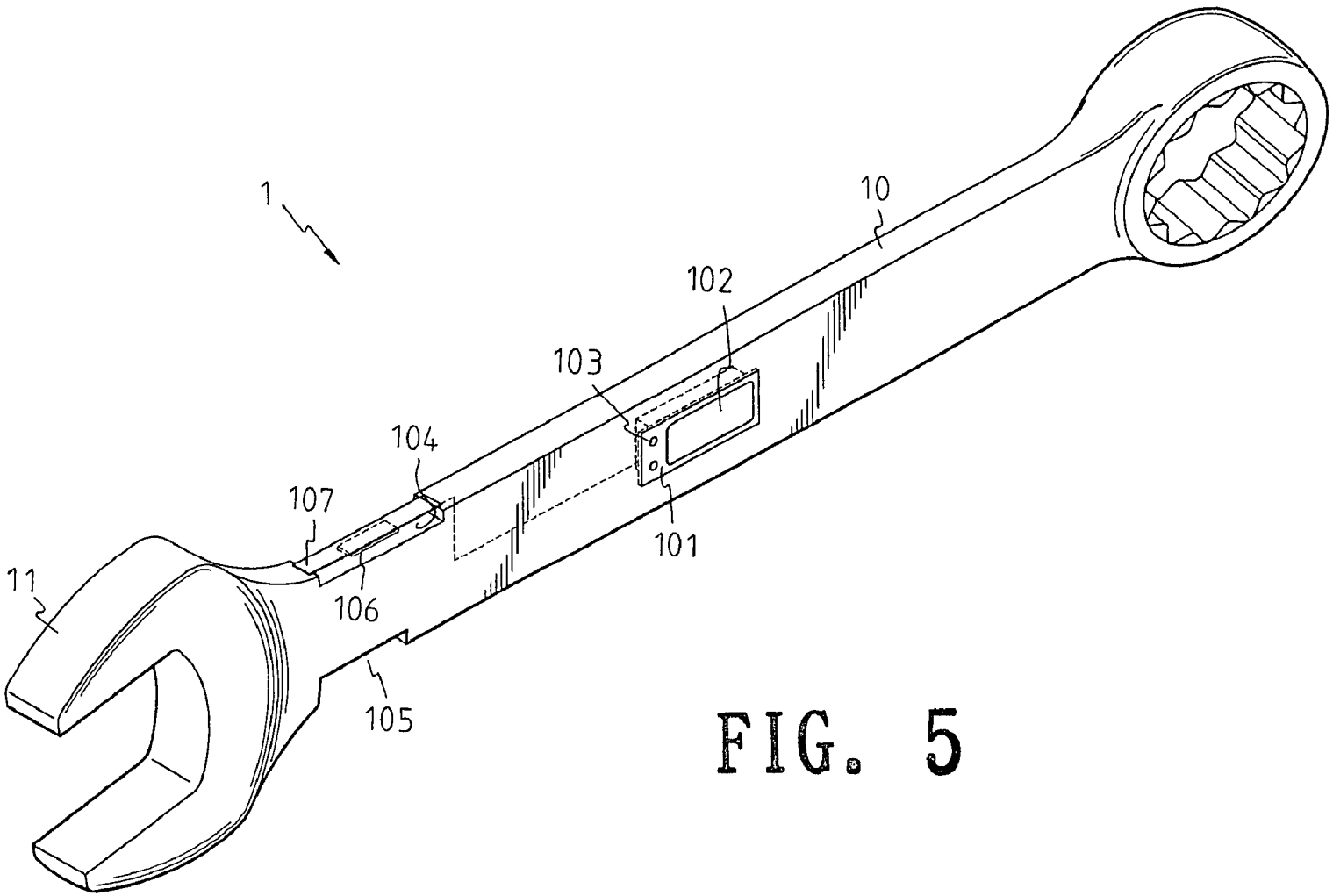
FIG. 5 is a perspective view about the second embodiment of the present invention.
Figure 6:
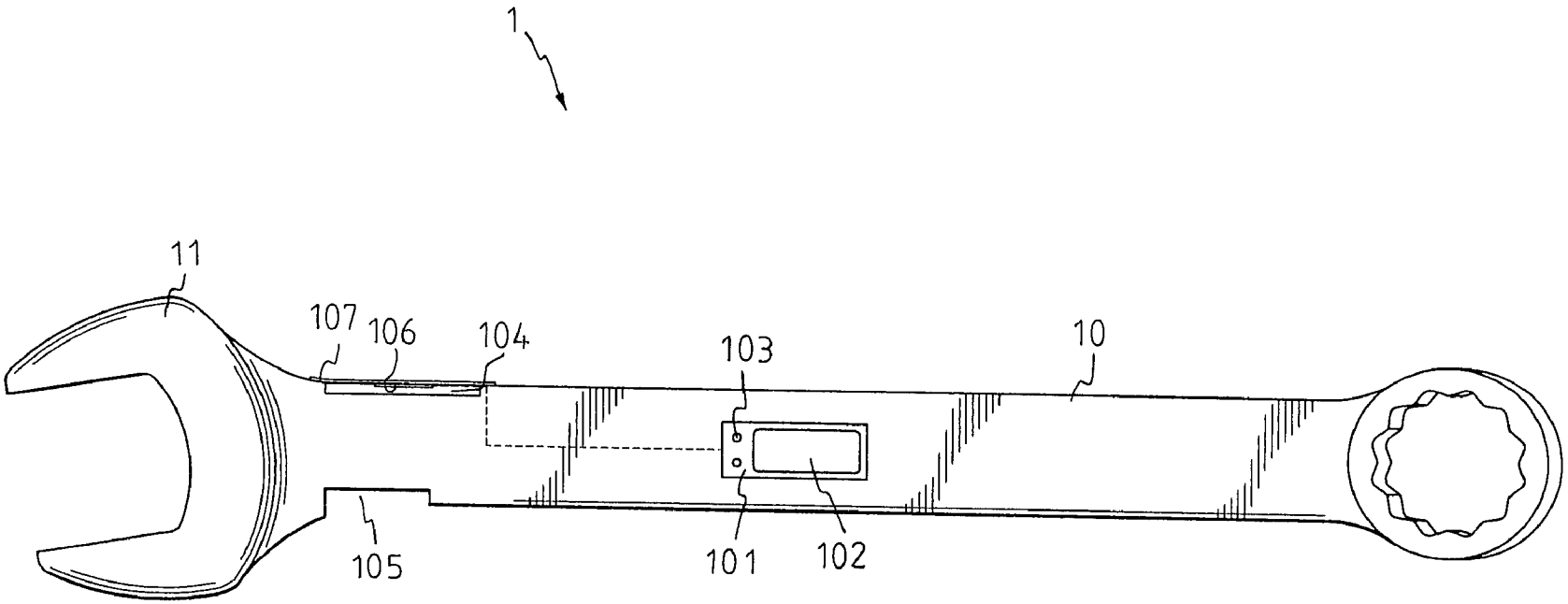
FIG. 6 is a lateral view of the second embodiment of the present invention.

Referring to FIGS. 4 to 6, the second embodiment about the handle tool with high sensitive electronic strain measurement of the present invention is illustrated. Those identical to the first embodiment will not be described herein.

Only those different are described herein. To be more sensitive in the present invention, a metal sheet 107 is installed in the first groove 104. The strain gauge 106 is installed on the metal sheet 107 so that the strain gauge 106 has a greater deformation as the tool body 1 is used. Thereby the sensitivity of the integrating element 101 is increased.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A handle tool with high sensitive electronic strain measurement comprising:

a driving portion for driving an object;

a handle connected to the driving portion; the driving portion being at one end of the handle; the handle having an integrating element; a first groove and a second groove being formed at two opposite sides of the handle and being near the driving portion; a length of the first groove being greater than that of the second groove; a strain gauge being embedded in the first groove; the strain gauge being electrically connected to the integrating element; the strain gauge being deformable with the deformation of handle of the tool body; the twisting force applied to the handle being calculated by the integrating element;

wherein the handle has a rectangular cross section with two long sides and two short sides; the first groove is cut from one of the two short sides into the long sides to form as an approximate U shape groove with a flat bottom and the second grove is cut from the other short side into the long sides to form as an approximate U shape groove with a flat bottom, and thus the first groove and the second groove are exposed at an outer side of the handle tool;

wherein the strain gauge located in the first groove is located on the flat bottom of the first groove;

wherein a display and at least one adjusting button are installed on the integrating element, the display serves for displaying the twisting force calculated on by the integrating element and the adjusting button serves to change the display unit or calibrate the precise of the display or reset the display.

2. The handle tool with high sensitive electronic strain measurement as claimed in claim 1, wherein a metal flat sheet is placed an opening of the first groove at the short side and a periphery of the first groove, but the metal flat sheet do not cover upon the long sides and another short side.

3. The handle tool with high sensitive electronic strain measurement as claimed in claim 1, wherein the driving portion is formed as one of an opened spanner, a ring spanner, a socket spanner, a ratchet spanner, a wrench, and a rapid operation spanner.

4. The handle tool with high sensitive electronic strain measurement as claimed in claim 3, wherein another end of the handle 10 having another driving portion which is a ring with inner teeth for driving another object.

* * * * *